United States Patent [19]

Scott

[11] Patent Number: 4,798,364

[45] Date of Patent: Jan. 17, 1989

[54] REINFORCED FORM LINER FOR SURFACE TEXTURING OF CONCRETE STRUCTURES

[76] Inventor: Samuel C. Scott, 2519 Walnut St., Denver, Colo. 80205

[21] Appl. No.: 6,013

[22] Filed: Jan. 22, 1987

[51] Int. Cl.[4] ..... E04G 9/05; E04G 9/10

[52] U.S. Cl. ..... 249/189; 249/16; 249/112; 249/114.1; 249/134; 264/225; 428/425.1

[58] Field of Search ..... 249/15, 16, 33, 55, 249/104, 112, 134, 140, 189, 114 R; 264/225, 255, 256, 278, 279, 333; 428/68, 425.1; 427/133

[56] References Cited

U.S. PATENT DOCUMENTS

| | | | |
|---|---|---|---|
| Re. 29,945 | 3/1979 | Scott | 249/80 |
| 1,623,625 | 4/1927 | Lake | 425/62 |
| 2,627,100 | 2/1953 | Jelles | 249/16 |
| 2,964,800 | 12/1960 | Dorsett | 264/112 |
| 3,245,648 | 4/1966 | Johansson et al. | 249/112 |
| 3,602,476 | 8/1971 | Iragorri | 249/96 |
| 4,037,816 | 7/1977 | Scott | 249/83 |
| 4,150,808 | 4/1979 | Sawyer | 249/112 |

FOREIGN PATENT DOCUMENTS

| | | | |
|---|---|---|---|
| 628088 | 9/1961 | Canada | 249/189 |
| 3129838 | 2/1983 | Fed. Rep. of Germany | 249/189 |
| 2133252 | 6/1987 | Japan | 249/189 |
| 894151 | 1/1982 | U.S.S.R. | 249/189 |

*Primary Examiner*—Jay H. Woo
*Assistant Examiner*—James C. Housel
*Attorney, Agent, or Firm*—James E. Pittenger

[57] ABSTRACT

A flexible surface plywood concrete form liner is disclosed which includes a flat planar sheet of relatively thick plywood material which has been precisely sized and squared. The prepared plywood sheet material is coated with a layer of relatively thin, flexible elastomeric material cast as a one-piece layer over the entire surface of one side of the plywood sheet material as well as all four edges. In this way, the elastomeric material is a continuous integral coating bonded directly to the surfaces of the plywood to prevent the penetration of moisture or chemicals from the concrete into the laminations of the plywood during use. A textured negative impression can be provided on the outer surface of the elastomeric material to leave a textured surface in the finished concrete. A novel edge seal which can be slightly angled is formed along the edges of the liner so that the joint between the liners is reinforced to strengthen and prevent blow-out of the concrete at the liner joints.

4 Claims, 3 Drawing Sheets

REINFORCED FORM LINER FOR SURFACE TEXTURING OF CONCRETE STRUCTURES

FIELD OF THE INVENTION

This invention is directed to an arrangement for reinforcing form liners for concrete construction. It is more specifically directed to a method and apparatus for strengthening and supporting flexible form liners for texturing the surface of concrete structures.

BACKGROUND OF THE INVENTION

It has been found in recent years that it is architecturally aesthetic to apply various surface texturing treatments to the exposed surface of concrete structures. These surfaces can have the appearance of brick, stone, wood and various other simulated materials which provide a very pleasing appearance to the overall structure upon completion.

In order to form this surface, negative impression textured liners are provided to be applied to the interior surfaces of the concrete form. These liners are usually made from flexible plastic or rubber-like materials which are quite flimsy and have no supporting structure. As a result these liners are usually cut in relatively small sizes such as 4'×8' or 4'×10' sheets which are relatively easy to handle and generally fit the standard size panels which are used to make up the concrete forms that are utilized in commercial and residential building construction.

Because of the flexible nature of the liner it has been found to be difficult to work with in an efficient manner. In fact, because of its flexible nature it is necessary to fasten the liner rigidly to the inside surface of the usual concrete forms in order to hold it in place while the concrete is poured into the forms and allowed to set. This attachment to the forms has normally taken place by fasteners or by adhering the liner to the inner surface of the form by means of a suitable adhesive. Most of the adhesives are permanent and thus preclude or greatly limit the reuse capability of the liner. In some cases the liner has been cut to the exact size of the form before or after it is attached. In addition, if the form and liner are carefully handled the form can be reassembled and reused for subsequent construction. The biggest problem that occurs in this reuse is the lack of a reliable edge sea between the form sections which allows the grout to seep between the edges of the form causing a "flashing" or seam to exist along the surface of the finished concrete. Because of this, it takes additional time to grind or remove this flashing from the set concrete in order to finish the surface of the structure.

It has also been found that when the liner is applied to the concrete forms especially in the field problems exist with adhering the liner to the form in order to prevent surface bubbles and loose areas. If this condition occurs the liner in many cases will be torn from the forms when an attempt is made to release the form and the liner from the concrete surface. Thus, additional time and effort is required to remove the form and liner without damaging the finished surface of the concrete.

It is well known in the trade that when concrete forms are made of plywood the panels must be coated with oil as a parting agent in an attempt to prevent the penetration of the cement water into the wood. Experience has shown that plywood panels rarely last more than three or four pours because of this and more particularly because the corners and edges are easily damaged in the form construction, shipping and storing. In addition, cement water draining from the concrete enters the cracks of the plywood joints and any damaged surface areas of the panels causing rapid deterioration and warping of the panel. Thus, even though plywood is the most common and lowest original cost forming media, it is quite restrictive and limited in its reuse which adds greatly to the overall cost of the concrete construction.

In the present invention the applicant has found a very novel and unique way of making and using a plywood form liner which is rigid and easy to handle as well as eliminating edge leakage even though the form liner may be reused a considerably number of times.

INFORMATION DISCLOSURE STATEMENT

The following patents which are believed to be pertinent to the subject matter of this invention are presented in compliance with the inventor's duty to disclose all information of which he is aware.

The Scott U.S. Pat. No. (4,037,817) shows an arrangement for an upright or vertical mold for forming a planar flexible elastomeric liner for large modular concrete forms. The mold includes a positive master of the flexible liner secured to a planar backing which forms a portion of the mold. A planar form member forming the back of the molded liner is positioned in the mold opposite the positive master surface. The liquid elastomer is poured into the edge of the upright mold with excess material provided along the top edge. This arrangement allows entrapped air to escape from the molded article prior to setting. A liner backing is supported on a separate framework which provides rigidity to the finished liner for positioning within the concrete form.

The Scott U.S. Pat. No. Re. 29,945 discloses a multiple use elastomeric liner having a rigid panel backing the flexible elastomeric negative mold liner. The panel provides rigidity to the liner and allows it to be used in the concrete form. In this arrangement the liner is formed separately and is attached to the surface of the backup panel by any suitable means such as attachment lugs extending through the panel or adhesives, nails or staples.

The Dorsett U.S. Pat. No. 2,964,800 discloses the manufacture of a concrete wall wherein a rubber matrix having a negative mold surface pattern is provided as a form liner. The form liner is suspended on the inside of the wall form adjacent to one side. A moisture barrier and heat reflector layer is provided on the inside surface of the opposite side to provide a surface finish for the opposite side of the poured concrete wall. After concrete has been poured into the form and set, the forms are removed leaving the rubber matrix liner embedded in the concrete as well as the moisture barrier and heat reflector layer. The liner is then stripped from the concrete leaving the desired surface pattern to improve the appearance of the finished concrete.

The Lake U.S. Pat. No. 1,623,625 provides a concrete molding apparatus which forms a concrete slab in a horizontal position. The bottom surface of the mold includes a negative impression liner which imparts a surface finish to the completed concrete panel. This arrangement allows the concrete to be poured in a horizontal position.

The Iragorri U.S. Pat. No. 3,602,476 discloses a method of forming a concrete panel which has actual brick facing blocks embedded in the surface of the panel. In this arrangement a horizontal mold is provided with a backed elastomeric negative liner positioned in the bottom of the mold. The individual facing bricks are inserted into the recesses formed in the liner and the concrete is poured into the horizontal mold to fill the entire cavity. The concrete adheres to the rear surface of the facing brick which causes it to adhere to the surface of the finished panel. This patent includes the process of making the negative liner which is used in the mold.

SUMMARY OF THE INVENTION

This invention is directed to a method of manufacturing a reinforced concrete form liner. The liner according to the present invention is self-supporting in that it can be used by itself to establish one side of the form used to fabricate the concrete structure. In most cases the liner which is produced by the present method will be used to form various vertical concrete surfaces such as retaining walls or building sidewalls.

The process according to the present invention includes the preparation of a flat planar mold intended to be positioned horizontally. An outside perimeter framework is provided which is of sufficient strength to withstand the lateral forces produced by the elastomeric material which is poured into the mold to form the liner composite. An inverted structural angle is provided along each longitudinal side of the mold for the purposes of clamping and supporting the reinforcing panel during the setting process. A liner is provided at the bottom surface of the mold which has a positive impression of the surface texture which is desired for the finished concrete. This positive insert is sized to closely fit the inside surface of the perimeter framework to provide a liquid-tight unit. The vertical sides of the interior surfaces of the framework are angled slightly outward at the bottom to provide a compression edge seal along the perimeter of the completed flexible liner.

Although most any sheet material having sufficient thickness and strength can be used as the reinforcing member it has been found that exterior grade plywood works quite well. The required thickness of the plywood is usually ½" to ¾". This material is both economical from a cost standpoint as well as providing sufficient strength in relation to the overall cost. It is not necessary to have an absolutely flat member so long as the overall material is relatively smooth.

The mold liner itself which provides the positive impressions can be made from an elastomeric material so as to further enhance the overall detail obtainable for the surface treatment. On the other hand it may be formed from a rigid material such as set concrete or metal and may use external or internal heating sources to accelerate the chemical action that cures the elastomeric material within the mold. Once the mold has been completed with all joints sealed the liner material such as settable polyurethane is cast or molded by being poured into the mold as a liquid. The level of the top surface of the material is brought up to a distance which is slightly less than the thickness of the reinforcing member. A plurality of stiffening and handling channels are attached to the back surface of the reinforcing member and suitably attached. The reinforcing member is then inserted into the mold with one edge inserted first so as to cause a rolling effect on the surface of the liquid material to help prevent the entrapment of air between the member and the liner. The member is then immersed until the back edge of the panel is flush with the top surface of the mold. Sufficient liner material must have been provided to cause the liner material to surround and coat the entire perimeter of the reinforcing panel member with at least a slight excess rising above the top of the mold surface.

The reinforcing panel member is sized to provide a minimum of one-eighth inch clearance around the entire perimeter of the reinforcing panel and the mold. In same cases the distance between the panel and mold can be as much as three-eighths of an inch with this dimension being a maximum.

Clamps are installed between the channels provided across the back surface of the reinforcing panel member and the edges of the mold to hold the panel in proper position flush with the top surface without movement.

Once the elastomeric material has properly set the clamps are released and the channels attached to the reinforcing panel member are wedged upward so as to release the reinforced flexible liner from the mold. After removal from the mold the channels are removed from the reinforcing member and the excess liner material around the back surface of the reinforcing member is removed so that it is flush with the surface of the panel reinforcing member. The removal of the excess elastomeric material can be accomplished by the use of a sharp cutter or a sanding machine such as a belt sander. The completed reinforced liner panel which can be of any required size such as 4'×8' or 4'×10' can then be carefully stacked and transported to the construction site for actual use.

The edges of the flexible liner produced by this process are quite important to the overall success of the product. In the process explained above the edges of the panel which are angled outwardly between 1° to 3° form a novel compression seal between adjacent surfaces and panels to prevent loss of the hydrating water present in the concrete and to eliminate the presence of a "flash line" in the finished concrete surface. This process is also unique from the standpoint that the bonding of the elastomeric member to the surface of the reinforcing material both on the contact surface as well as the edges prevents the deterioration of the reinforcing member from the moisture present within the concrete and the associated environment during the construction process. As can be seen the present process for making the flexible concrete form liner is quite simple which supports the novelty involved in this arrangement.

Other features and advantages of the present invention will become apparent from the following detailed description of the invention when it is considered in conjunction with the accompanying drawings.

DETAILED DESCRIPTION OF THE DRAWINGS

Figure 1:
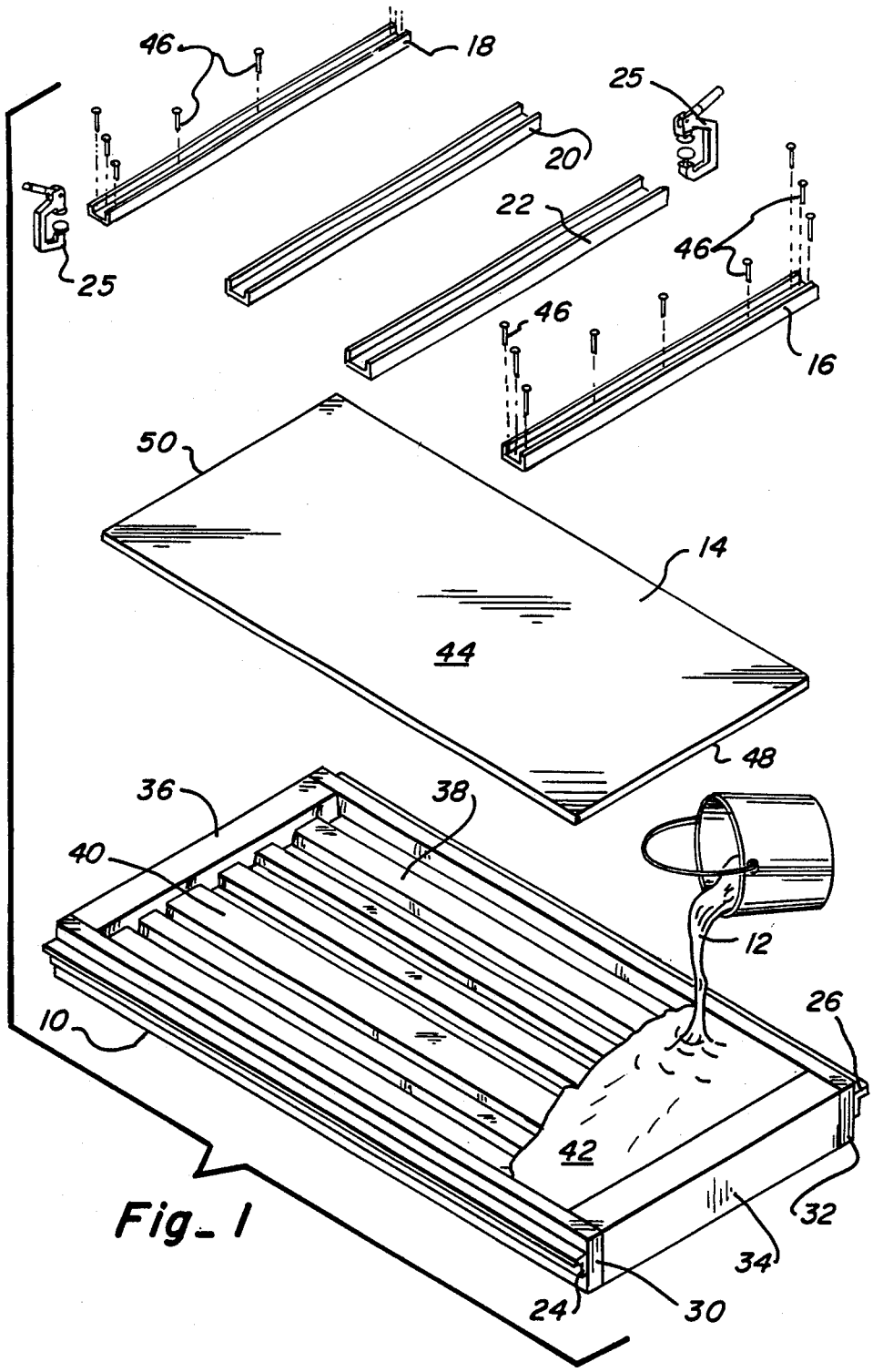
FIG. 1 is a pictorial perspective exploded view of the process according to the present invention for forming a flexible concrete form liner.
Figure 2:
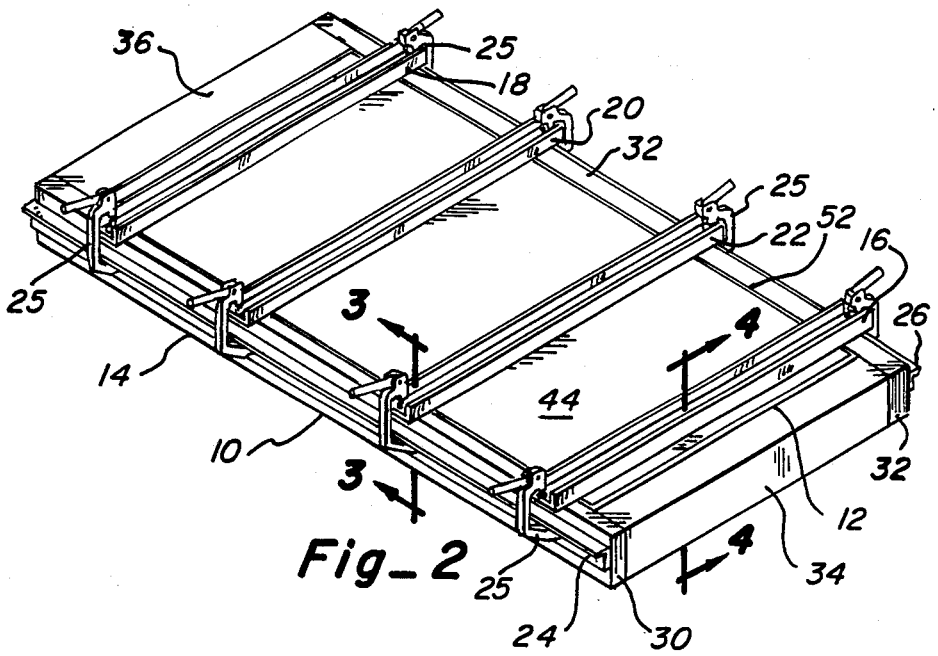
FIG. 2 is a pictorial perspective view of the mold for the liner process which is shown in FIG. 1.
Figure 3:
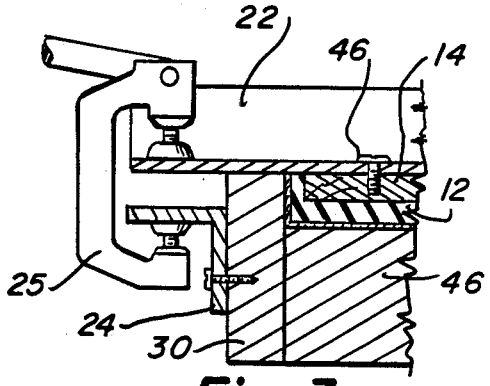
FIG. 3 is a partial cross-sectional view taken along lines 3—3 of FIG. 2.
Figure 4:
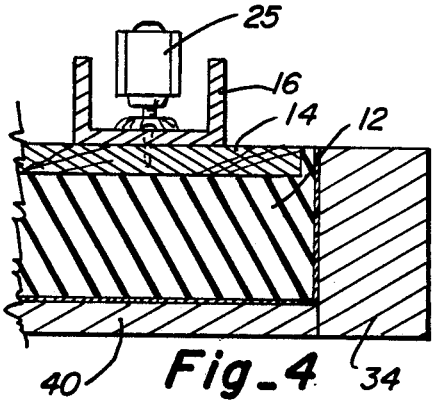
FIG. 4 is a partial cross-sectional view taken along lines 4—4 of FIG. 2.

Turning now more specifically to FIG. 1, the process according to the present invention includes the positive mold 10 which is ready to receive the elastomer 12 and reinforcing panel member 14 which is supported and positioned within the mold by channels 16, 18, 20 and 22. A pair of structural angles 24, 26 are provided along the longitudinal sides of the mold 10. Clamps 25 which can be of the screw or toggle type are arranged to hold the ends of the channels 16, 18, 20 and 22 in proper position with respect to the angles 24, 26. As will be explained later this properly positions and holds the reinforcing panel member during the flexliner forming process.

The positive mold 10 is composed of side channels 30, 32 and end members 34, 36 which establishes a frame for the mold. The bottom 38 can be formed from a single planar member or can be formed from a plurality of support sheet materials which can be built up in a composite fashion. The upper surface of the bottom planar member 38 incorporates a positive impression of the surface trexture which is desired on the finished concrete surface. Thus, this surface treatment is an exact duplicate of the actual surface texturing or treatment which will be present on the final concrete structure. The positive mold surface 40 as shown in FIG. 1 depicts a series of parallel flat ridges which have the same height but varying widths. In a panel which is formed in this manner the longitudinal axis is usually the vertical axis on the finished structure. It is to be understood, however, that this is not always true and that the longitudinal axis of the mold can be actually the horizontal axis of the structure depending upon the type of construction and surface texture which is desired.

During construction of the positive mold the outside perimeter side members 30, 32 and end members 34, 36 are quite stout in comparison with the usual type of structure used in horizontal molds. In order to provide additional strength the side members 30, 32 extend and overlap the ends of the end members 34, 36 in order that the fasteners holding the elements together are placed in sheer rather than tension to provide additional strength. The structural angles 24, 26 are permanently attached to the outside of the side members 30, 32 with the outward extending flange on the upper side in order to facilitate the clamping of the liner support channels as well as provide rigidity to the mold side members.

The positive mold liner 40 which is used to line the bottom of the mold 10 can be made from either a flexible elastomeric material or a solid rigid material. The bottom liner is sized to fit snuggly within the side and end members to seal the mold to prevent leakage and to provide a finished surface for the completed flexible form liner.

In most cases the liner 50 is formed by molding and curing liquid polyurethane precursors, or other suitable precursors for synthetic polymers. The polyurethanes are generally poly-functional long chain alcohols with a plurality of hydroxyl groups reacted with a polyiscocyanate. The polyurethanes themselves are esters of dicarbamic acids and glycols or inter-molecular esters of gamma-hydroxic carbamic acids. The polyurethane elastomers are made from diisocyanates, aliphatic polyesters, etc. Several types of polyurthanes are commercially available as two-part pourable liquids, which have a good shelf life and are easily mixed with the necessary polymerizing or curing agent. One form is a polyester made from ethylene and propylene glycols with adipic acid. A curing agent such as toluene, naphthylene or diphenylmethane diisocyanates may be used. The resultant polymer should have the hardness, tensile modulus, elongation, tear strength, tensile strength and abrasion resistance which is common for materials used as liners for concrete forms. One of the specific liners manufactured by the applicant is a polyurethane called "Flexliner" having a Shore A hardness of 53–56, a tensile modulous of 212–234 psi, an elongation of 270–300%, tear strength of 67–73 psi and a tensile strength of 504–563 psi.

Properly mixed, the two-part elastomeric material 12 which can be used in the present process will cure to sufficient hardness in approximately 30 minutes depending upon the temperature and the environment. As is generally known this time can be reduced somewhat by providing additional heat externally to or internally within the positive mold 10. Usually the 30 minute time period for setting of the elastomeric material is quite sufficient to allow the remainder of the process to be completed without problem.

The liquid elastomeric material 12 is poured into the relatively shallow mold 10 until the upper surface 42 is a distance from the top edge of the mold which is slightly less than the thickness of the reinforcing panel member 14. At least two of the channel members 16, 18 are attached to the upper surface 44 of the panel member 14 by wood screws 46 or other suitable fasteners. It has been found that attaching two of the channels has been sufficient with the remainder of the stiffening channels 20, 22 being merely laid across the central portion of surface once the panel has been positioned within the mold.

In preparation for the liner forming process the panel 14 is properly sized so that the longitudinal and lateral dimensions will allow between a $\frac{1}{8}$" to $\frac{3}{8}$" clearance around the edges of the panel when positioned within the positive mold 10. With the elastomer 12 properly filling the mold 10 the reinforcing panel member 14 is positioned within the mold 10 by starting one edge such as the lateral edge 48 and slowly lowering the panel 14 into the mold until the edge 50 is fully submerged in the elastomer 12. By carefully controlling the emersion of the panel 14 into the liquid material 12 until the upper surface 44 of the panel is flush with the upper surface of the mold 10 the elastomeric liquid material will coat and bond with the entire undersurface of the panel 14 without air bubbles and will be forced upward around the edges of the panel so as to completely seal the surface of the panel in contact with the material as well as all of the edges of the panel. This bonding process and the provision of a thin layer of the elastomeric material around the entire perimeter edge of the panel prevents the panel material from being subjected to the water and chemicals which are present in the concrete during the construction process. In this way the flexible liner panel 50 formed herein can be used a number of times so long as the panel is handled carefully and the liner surface is protected from damage.

When the reinforcing panel member 14 is properly positioned in the horizontal mold 10 so that the surface 44 is flush with the top surface of the mold it is desirable that an excess amount of the elastomeric material 12 will be present to form at least a small bead above the surface of the reinforcing member 14. This bead is desirable be sure that a complete edge seal is formed around the entire perimeter of the flexible liner. Once the panel member 14 has been properly positioned so that the channels 16, 18 rest on the top surface of the side members 30, 32 the clamps 25 are installed between the ends of the reinforcing channels 16, 18, 20 and 22 and the side angles 24, 26 to properly position the reinforcing panel member 14 and assure that it will be retained in a flat planar condition.

Once the elastomeric material 12 has properly set the clamps 25 can be removed as well as the stiffening channels 20, 22. By a wedging action usually with a pry bar the channels 16 or 18 are used to wedge one end of the finished reinforced flexible liner 50 from the mold 10. In some cases depending upon the type of the elastomeric material used it may be necessary to apply a release coating to the inside of the mold 10 to facilitate the removal of the liner 50.

Figure 5:
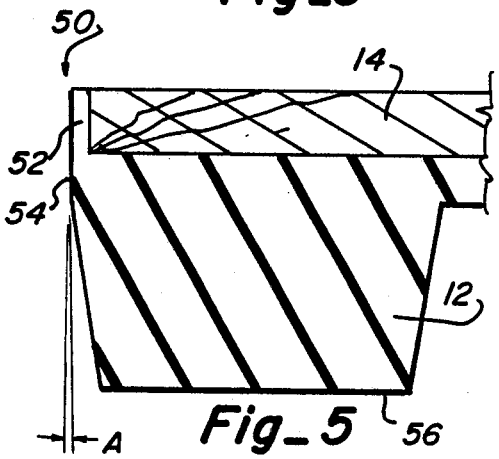
FIG. 5 is a partial cross-sectional view of one edge of the flexliner formed by the present process.
Figure 6:
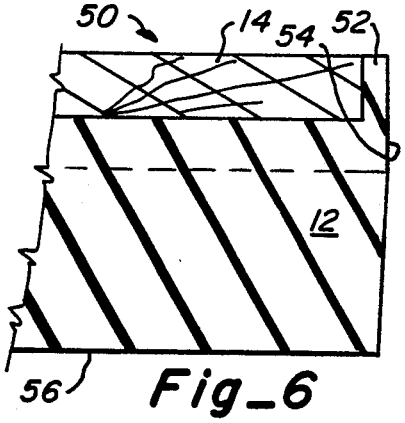
FIG. 6 is a partial cross-sectional view of the opposite edge of the same liner as shown in FIG. 5.
Figures 7, 8, 9:
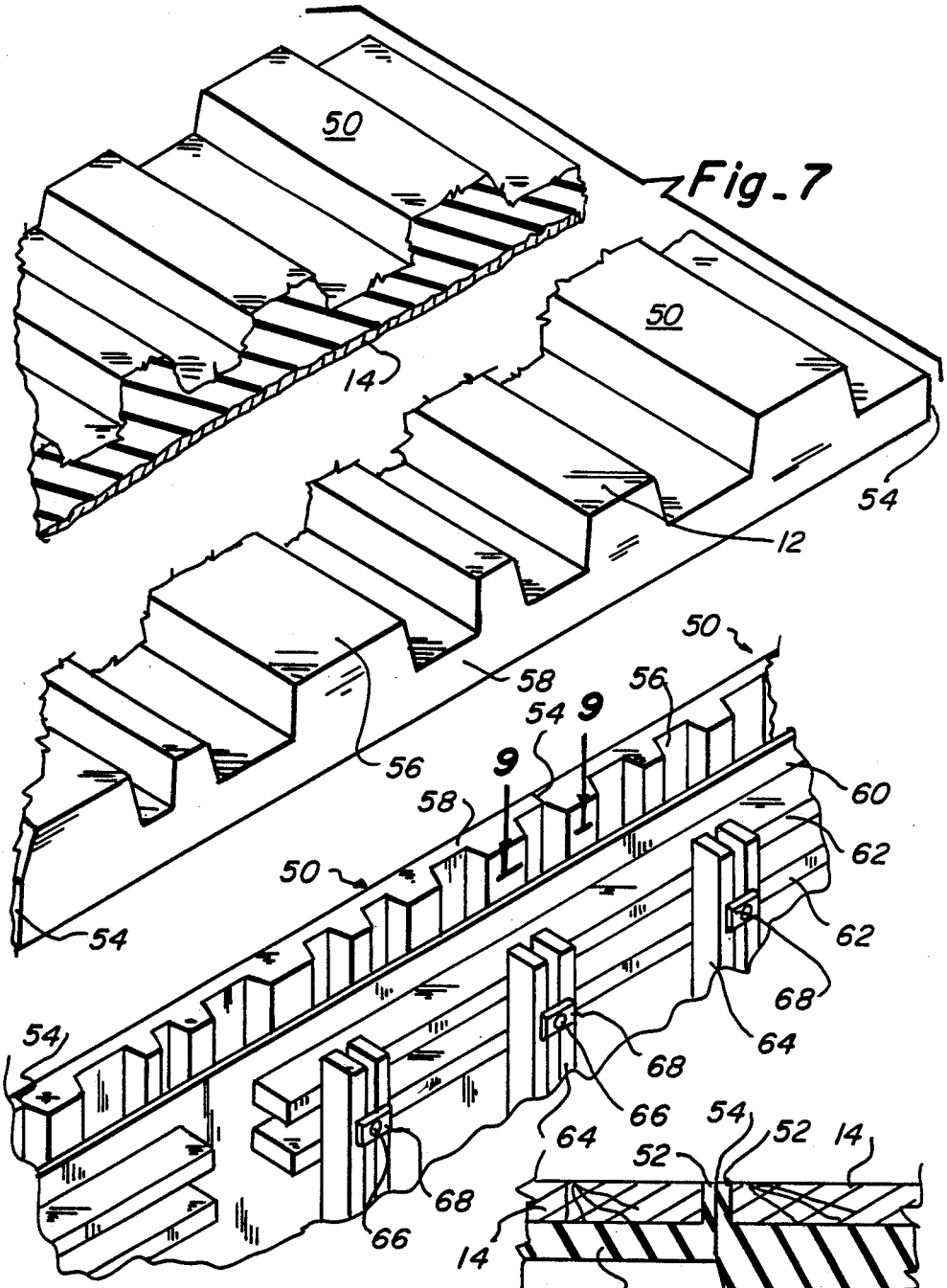
FIG. 7 is a segmented perspective view of the top of the negative surface of the liner.
FIG. 8 shows a partial perspective view of several reinforced flexliner panels assembled to make one side of a form for a concrete wall.
FIG. 9 is a partial cross-sectional view taken along lines 9—9 of FIG. 8 showing the edge seal provided between the adjacent reinforced panels.

The completed liner 50 as shown in FIGS. 5, 6 and 7 includes the back reinforcing panel member 14 and the flexible elastomeric material 12. The edges 52 of the elastomeric material encompass and surround the edges of the member 14 with the outside surface 54 of the edge 52 forming a sealing surface. This edge is slightly divergent in that the positive mold 10 is shaped so that these edges will diverge outwardly in the direction shown by angle A. In this way the front edge of the surface 54 extends slightly beyond the back of edge 52 adjacent to the back panel 14. The angle A is usually within the range of 1° to 3° with 2° being an acceptable compromise. Even though this angle is very slight it is quite sufficient to form a compressive edge seal with adjacent liners or support surfaces such as floors or foundation footings. It is important that the edge seal 52 be no thicker than ⅜" in order to provide sufficient rigidity in the seal for proper support to prevent "blow outs". In this way the reinforcing panel member 14 extends within a maximum of ¾" with the reinforcing panel of the adjacent liner. This dimension will also allow for variations in the surface condition of the edge seal to account for any minor damage that may be incurred during the handling of the liner.

In use as shown in FIGS. 8 and 9 the reinforced form liner which is the product of the process shown and described in this application can be used on one side or both sides of a concrete form arranged for such structures as for pouring a concrete wall. The edges 54 of the respective flexible form liners 50 provide the required seal with the adjacent liners while the liners and the opposite form panels are supported by walers 62 and vertical ribs 64. Cross ties 66 can be inserted transversely across the forms to add additional strength and can be held in position by wedge type tie retainers 68.

As can be seen herein the reinforced flexible liners 50 are unique from the standpoint that they are integral and self-contained having the reinforcing member embedded directly in the liner itself. In this way there is no need to adhere a flexible liner sheet to the outside of an individual panel which fails to provide a satisfactory flexible seal between the reinforcing panels themselves. Although in the prior art the edges of the flexliners have been arranged to abut each other, they still fail to provide the unique sealing feature which is provided in the panels of the present invention. Thus, the reinforcing panels in the present invention support the flexible seal directly between the edges of the panels which make up the forms and provide the unique result which has not been found in the past.

While a process and apparatus for a reinforced flexible concrete form liner has been shown and described in detail in this application, it is to be understood that this invention is not to be limited to the exact process and form disclosed and changes in detail and construction may be made without departing from the spirit thereof.

What is claimed is:

1. A flexible surfaced plywood concrete form liner which can be used to form a textured surface in concrete wall construction, said form liner comprising:
   (a) a flat planar sheet of relatively thick plywood material, said plywood sheet material being precisely sized for use in concrete wall construction;
   (b) a layer of relatively thin, flexible, waterproof, elastomeric material, said elastomeric material being cast around and bonded to said plywood sheet, said elastomeric material forming a continuous integral coating covering one completed planar side of said plywood material and all edges of said plywood material leaving the opposite side exposed, the elastomeric material along the edges having a thickness within the range of ⅛th to ⅜ths inch to provide a flexible seal between forms and yet have sufficient rigidity to prevent concrete blow-out at the joint;
   (c) the outer surface of said layer of elastomeric material opposite said plywood material having a negative impression textured surface which is intended for texturing the surface of the finished concrete; and
   (d) said elastomeric material completely seals one side and all edges of said plywood material to prevent any possible absorption of the concrete or moisture into the lamination of the plywood material during use to greatly extend the useful life of the form.

2. A concrete form liner as defined in claim 1 wherein the perimeter edges of the elastomeric material are angled outwardly toward said textured surface within the range of 1° to 3°.

3. A concrete form liner as described in claim 1 wherein the exposed side of said plywood and the edges of said elastomeric seal are formed flush to produce a smooth outer surface on the form.

4. A concrete form liner as described in claim 1, wherein the plywood sheet is a squared rectangular configuration and all four edges of the sheet are covered by the integral elastomeric coating.

* * * * *